US012331596B2

(12) United States Patent
Gray

(10) Patent No.: US 12,331,596 B2
(45) Date of Patent: Jun. 17, 2025

(54) CONDUCTIVE ENCAPSULATION OF A TUBING ENCAPSULATED CONDUCTOR FOR POWERING EQUIPMENT IN WELLBORE OPERATIONS

(71) Applicant: Halliburton Energy Services, Inc., Houston, TX (US)

(72) Inventor: Matthew S. Gray, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/377,391

(22) Filed: Oct. 6, 2023

(65) Prior Publication Data

US 2025/0116162 A1 Apr. 10, 2025

(51) Int. Cl.
*E21B 17/00* (2006.01)
*E21B 17/02* (2006.01)

(52) U.S. Cl.
CPC ..... *E21B 17/003* (2013.01); *E21B 17/028* (2013.01)

(58) Field of Classification Search
CPC ... E21B 17/003; E21B 17/028; E21B 41/0085
See application file for complete search history.

(56) References Cited

U.S. PATENT DOCUMENTS 3,158,420 A * 11/1964 Olson ..... H01R 13/523 439/426
5,174,765 A * 12/1992 Williams ..... E21B 17/028 439/924.1
2008/0185155 A1 8/2008 Emerson
2011/0108267 A1* 5/2011 Chaize ..... E21B 17/028 166/242.6
2013/0327572 A1 12/2013 Sponchia et al.
2016/0265337 A1* 9/2016 Chen ..... E21B 10/08
2018/0058157 A1 3/2018 Melo et al.
2021/0233679 A1 7/2021 Dinkins et al.
2022/0393461 A1 12/2022 Pihl et al.

OTHER PUBLICATIONS

PCT/US2023/034628 , "International Search Report and Written Opinion", Jul. 4, 2024, 11 pages.

* cited by examiner

*Primary Examiner* — Brad Harcourt
(74) *Attorney, Agent, or Firm* — Kilpatrick Townsend & Stockton LLP

(57) ABSTRACT

A system can be provided for supplying power to downhole equipment during a wellbore operation performed with respect to a wellbore. The system can include a tubing positioned downhole in the wellbore. The system can also include a tubing encapsulated conductor (TEC) positioned downhole in the wellbore. The TEC can be in contact with the tubing at one or more locations along a length of the tubing. The TEC can include an interior wire for transmitting electricity from a power source to at least one piece of electrical equipment during the wellbore operation. The TEC can also include a metal sheath positioned around the interior wire and a conductive encapsulation layer. The conductive encapsulation layer can be positioned on an outer side of the metal sheath and can be positioned to facilitate one or more electrical couplings between the metal sheath and the conductive item at the one or more locations.

18 Claims, 4 Drawing Sheets

CONDUCTIVE ENCAPSULATION OF A TUBING ENCAPSULATED CONDUCTOR FOR POWERING EQUIPMENT IN WELLBORE OPERATIONS

TECHNICAL FIELD

The present disclosure relates generally to wellbore operations and, more particularly (although not necessarily exclusively), to a Tubing Encapsulated Conductor with a conductive encapsulation layer for supplying power to electrical equipment used in wellbore operations.

BACKGROUND

A wellbore can be formed in a subterranean formation for extracting produced hydrocarbon or other suitable material. Wellbore operations can be performed to extract the produced hydrocarbon material, and may include deployment, completion, and production operations. As part of performing a deployment operation, electrical equipment, such as a sensors, valves, and pumps, may be deployed downhole in the wellbore. Power can be supplied to the electrical equipment during deployment via a control line, such as a Tubing Encapsulated Conductor (TEC). The TEC can be encapsulated by a plastic-like polymer suitable for well conditions. The plastic-like polymer can provide electrical insulation on an outer surface of the TEC. Due to the insulation, both a positive electrical path and a ground side electrical path must flow through the TEC during deployment operations. In particular, the positive electrical path can flow from the power source to the electrical equipment via conductors of the TEC and the ground side electrical path can flow back to the power source through a metal sheath of the TEC. The metal sheath can exhibit high electrical resistance causing power requirements for powering the electrical equipment via the TEC to be high during deployment operations. Thus, using the metal sheath as a ground may limit or prohibit essential functions of the electrical equipment.

Additionally, after deployment operations, the TEC can be connected to a production tubing hanger, at which point the ground side electrical path can flow through the production tubing hanger, downhole tubing, or a combination thereof of the wellbore rather than the metal sheath. The production tubing hanger and the downhole tubing can exhibit significantly less electrical resistance than the metal sheath. Therefore, during well preparations, deployment of the electrical equipment, system integration tests, deck testing, etc. power requirements for the electrical equipment can be significantly higher than power requirements after the TEC is connected to the production tubing hanger. This can result in inefficient or inconsistent functioning of the electrical equipment and can limit types of electrical equipment that can be used during wellbore operations.

DETAILED DESCRIPTION

Figure 1:
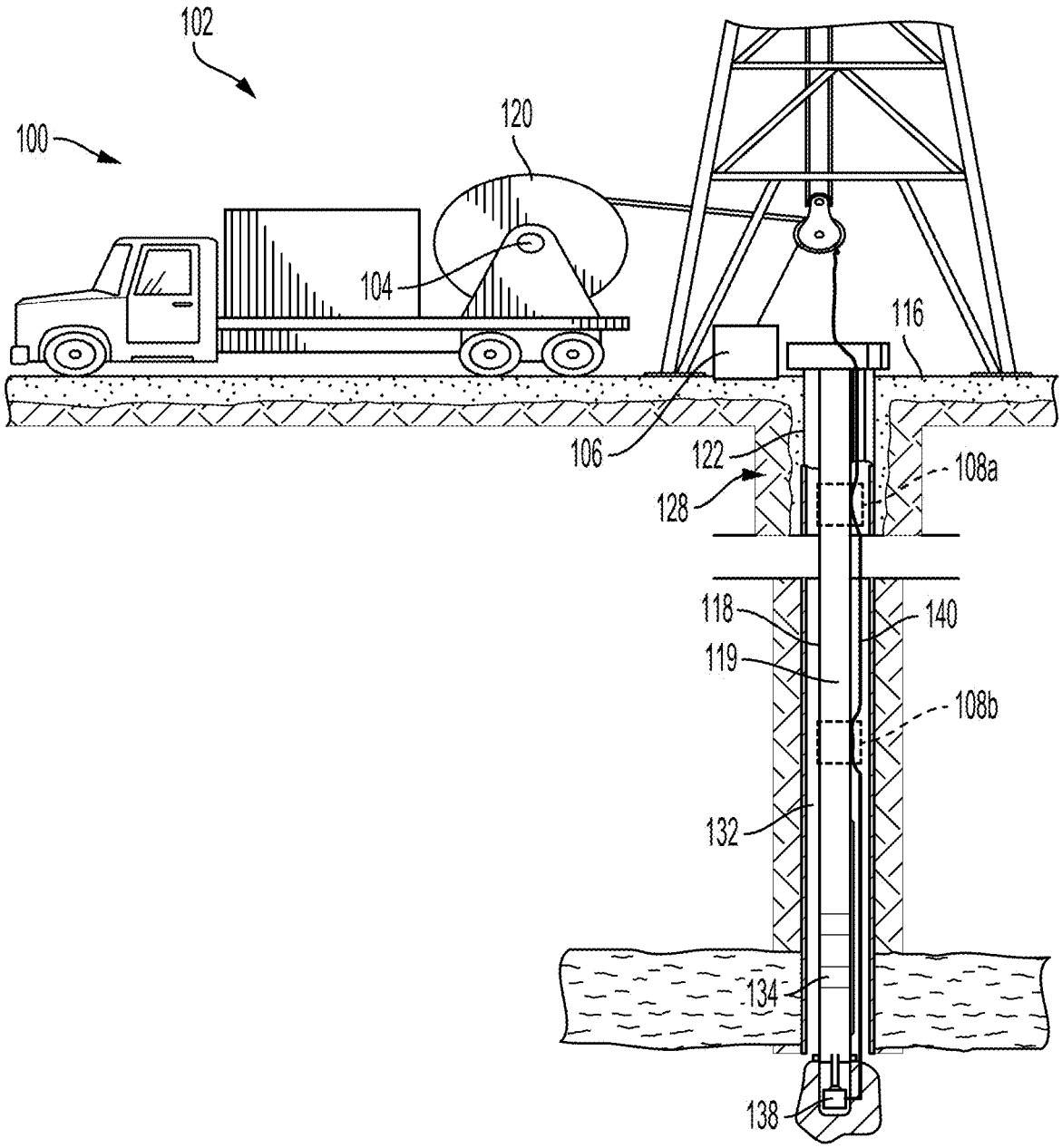
FIG. 1 is a schematic of a well system having a production tubing system for deploying production tubing in a well operation according to one example of the present disclosure.

Certain aspects and examples of the present disclosure relate to a Tubing Encapsulated Conductor (TEC) with a conductive encapsulation layer for supplying power to downhole electrical equipment used in wellbore operations. The TEC can be a type of electrical control line that includes one or more conductors surrounded by a protective tubing or sheath. In particular, the one or more conductors can be wires made of copper, aluminum, or other suitable materials. Each of the one or more conductors can be surrounded by an insulated tubing for protection. Then a filler material, such as epoxy resin, polyurethane, silicone, etc., can be used to fill voids between the one or more conductors and a metal sheath. The filler material can provide mechanical stability and can prevent movement or deformation of the one or more conductors within the TEC. The metal sheath can be another protective barrier that encompasses the one or more conductors and the filler. In particular, the metal sheath can act as a pressure barrier for the one or more conductors and can be compatible with a downhole environment of the wellbore. Additionally, a conductive encapsulation layer can make up an outermost layer of the TEC. The conductive encapsulation layer can be made of a polymer in which electrically conductive particulates or electrically conductive fibers are added. The conductive encapsulation layer can provide some flexibility or deformation for the TEC and can shield the metal sheath against abrasion, chemicals, moisture, or other environmental factors of the wellbore. The conductive encapsulation layer can also act as a buffer between the metal sheath and a tubing or casing positioned in the wellbore to dampen vibrations or prevent other suitable undesirable interactions between the metal sheath and tubing or casing.

In some examples, the conductive encapsulated layer can be made by including the electrically conductive particulates, electrically conductive fibers, or other suitable conductive additives with the plastic-like polymer during an encapsulating process for the TEC. The conductive encapsulation layer can then provide a direct conductive path between the metal sheath and any conductive item, such as the tubing, that the TEC may be touching during testing and deployment operations. As a result, a ground side electrical path can flow from the metal sheath to the tubing. Due to tubing exhibiting a lower electrical resistance than the metal sheath, the conductive path facilitated by the conductive encapsulation layer can reduce electrical resistance associated with grounding the TEC during testing and deployment operations. In this way, functioning of the electrical equipment can be improved and a variety of electrical equipment can be implemented downhole. Additionally, due to the conductive encapsulation layer, there can be conductive paths between layers of TEC while on a drum of control line to improve system integration and deck testing.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 having a production tubing system 102 for retrievably deploying production tubing 118 in a well operation. Although a land-based production tubing system 102 is depicted in FIG. 1, a production tubing string can be deployed from floating rigs, jackups, platforms, subsea wellheads or any other well location. Aspects of the disclosure may be used for producing hydrocarbons from a wellbore 122.

The well system 100 has the production tubing system 102, which generally utilizes a production tubing string 118, e.g., to conduct various deployment, drilling, and production operations. As used herein, the term "production tubing string" will include any pipe string that may be deployed in a wellbore 122 including continuous metal tubulars such as low-alloy carbon-steel tubulars, composite tubulars, capillary tubulars and the like. Additionally, although a production tubing system 102 with production tubing string 118 is depicted, the well system 100 can include any type of tubing. For example, completion tubing may be used in place of the production tubing string 118.

The production tubing string 118 can include an inner annulus or flow bore 119 extending therebetween. The production tubing system 102 may also include a power source 104 and a command station 106 for controlling wellbore operations. Thus, the production tubing system 102 may be used in this example for servicing a pipe system 128. For purposes of this disclosure, pipe system 128 may include casing, risers, tubing, drill strings, completion or production strings, subs, heads or any other pipes, tubes or equipment that couples or attaches to the foregoing, such as collars, cleaning tools, and joints, as well as the wellbore 122 itself and laterals in which the pipes, casing and strings may be deployed. In this regard, pipe system 128 may include one or more casing strings, which may be cemented in wellbore 122. An annulus 132 is formed between the walls of sets of adjacent tubular components, such as concentric casing strings or the exterior of production tubing string 118 and an inside wall of wellbore 122.

A permanent downhole gauge carrier 134 or a series of permanent downhole gauge carriers may be coupled to a downhole end of the production tubing string 118. Disposed downhole of the permanent downhole gauge carrier(s) 134 may be electrical equipment 138, which may include motors, valves, etc. A tubing encapsulated conductor (TEC) 140 can run from a drum 120 located at a surface 116, proximate to the production tubing string 118, and may be electrically coupled to the permanent downhole gauge carrier 134. The TEC 140 may include electrical conductors and may operably couple the permanent downhole gauge carrier 134 to the command station 106. Thus, the TEC 140 may be used as a conduit for electric power.

For example, the conductors can be one or more interior wires, which can transmit electricity from the power source 104 to the permanent downhole gauge carrier 134, the electrical equipment 138, or a combination thereof. The TEC 140 can further include a metal sheath positioned around the one or more interior wires to act as a pressure barrier. Additionally, the outermost layer of the TEC 140 can be a conductive encapsulation layer. The conductive encapsulation layer can contact a conductive item, such as a casing strings or the production tubing string 118 of the wellbore at various locations. For example, as depicted, cross coupling clamps 108*a-b* may be used for coupling the TEC 140 and the production tubing string 118. In this way, the conductive encapsulation layer can facilitate electrical connections between the metal sheath and the conductive item at the various locations. As a result, the power source 104 can efficiently power the permanent downhole gauge carrier 134, the electrical equipment 138, or a combination thereof via the TEC 140.

Additionally, in some examples, a portion of the TEC 140 can be positioned downhole in the wellbore 122 and a second portion of the TEC 140 can be positioned on the drum 120 associated with the wellbore 122. For the portion of the TEC 140 coiled around the drum 120, the conductive encapsulation layer can facilitate electrical connections between layers of the second portion of TEC 140. As a result, the electrical connections can reduce conductive resistance during testing prior to deploying the TEC 140 into the wellbore 122.

Figure 2:
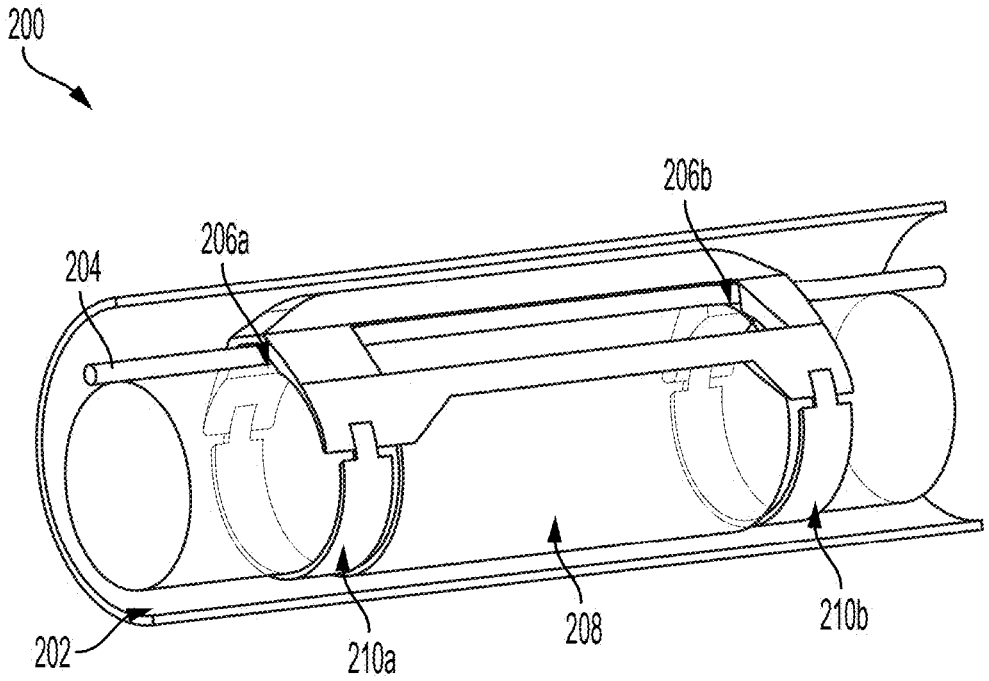
FIG. 2 is a schematic of a system for deploying a TEC with a conductive encapsulation layer according to one example of the present disclosure.

FIG. 2 is a schematic of a system 200 for deploying a Tubing Encapsulated Conductor (TEC) 204 with a conductive encapsulation layer according to one example of the present disclosure. The system 200 can include a tubing 208, which may be positioned in a casing 202. In some examples, the tubing 208 can be production tubing, such as the production tubing string 118 depicted in FIG. 1. Additionally, the tubing 208 can be positioned in a wellbore, such as the wellbore 122 depicted in FIG. 1. The TEC 204 can be mechanically and electrically coupled to the tubing 208. For example, at locations 206*a-b* along the tubing 208, the TEC 204 can be coupled to the tubing 208 via cross-coupling clamps 210*a-b*.

During a wellbore operation, such as a deployment operation, electrical equipment can be deployed downhole in the wellbore. Additionally, the TEC 204 can be deployed in the wellbore. For example, the TEC 204 can be run from a drum into the wellbore. The TEC 204 may then be held in place against the tubing 208 at the locations 206*a-b* and protected using the cross-coupling clamps 210*a-b*. The TEC 204 can further electrically couple a power source associated with the wellbore and electrical equipment located downhole within the wellbore during deployment. The power source can be a generator or other suitable power source positioned at a surface of the wellbore. The electrical equipment can be tubing conveyed electrically operated completions equipment or other suitable downhole electrical equipment. Examples of the electrical equipment can include pumps, downhole monitoring tools, or other suitable equipment.

The TEC 204 can include one or more interior wires for transmitting electricity from the power source to the downhole electrical equipment. The TEC 204 can also include a metal sheath around the one or more interior wires. The metal sheath can act as a ground for a circuit that includes the power source, the TEC 204, and the electrical equipment. But, the metal sheath can be characterized by high electrical resistance, which can increase power requirements for supplying power to the electrical equipment via the TEC 204. To reduce the electrical resistance, a conductive encapsulation layer of the TEC 204 can facilitate electrical coupling of the metal sheath and the tubing 208. To facilitate the electrical coupling, the conductive encapsulation layer can be made of or include conducting materials. For example, the conductive encapsulation layer can include an electrically conductive particulate, an electrically conductive fiber, or a combination thereof, which can be added to a polymer during an encapsulation process of the TEC 204.

The electrical coupling of the metal sheath and the tubing 208 can occur at locations 206*a-b* along the tubing. Due to the electrical coupling, the tubing 208 can act as a ground for the circuit. Thus, a positive electrical path can flow from the power source to the electrical equipment via the one or more interior wires. Then, a ground side electrical path can flow from the electrical equipment, through the metal sheath and the tubing 208, to the power source. The electrical resistance of the metal sheath can be greater than an electrical resistance of the tubing. Therefore, by electrically coupling the metal sheath and the tubing 208 via the conductive encapsulation layer electrical resistance can be reduced and the electrical equipment can be powered more efficiently.

Figure 3:
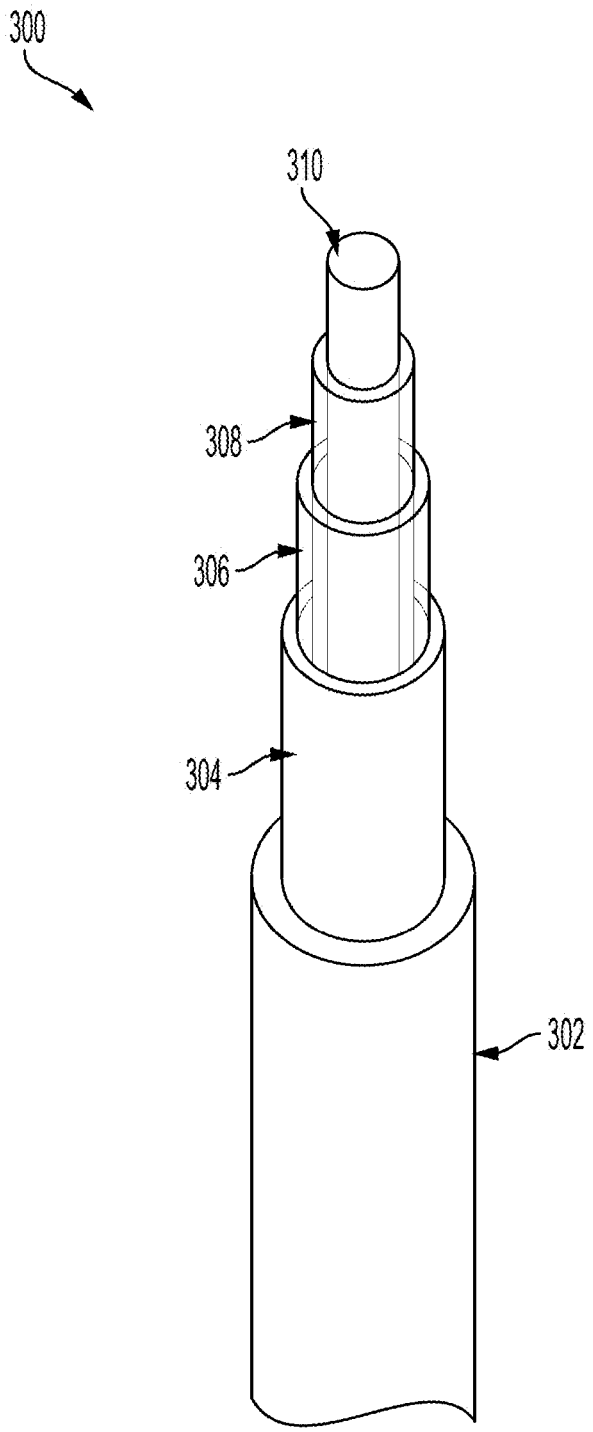
FIG. 3 is a schematic of a TEC with a conductive encapsulation layer for supplying power to electrical equipment according to one example of the present disclosure.

FIG. 3 is a schematic of a Tubing Encapsulated Conductor (TEC) 300 with a conductive encapsulation layer 302 for supplying power to electrical equipment according to one example of the present disclosure. The TEC 300 can supply the power during wellbore operations such as deployment, completion, and production operations.

The TEC 300 can include an interior wire 310 made of a conducting material such as copper, copper alloy, or aluminum. The interior wire 310 can be the central component of the TEC 300, which carries electrical current. The TEC 300 can also include an insulated tubing 308 which can surround the interior wire 310 to provide electrical insulation and protection for the interior wire 310. The insulated tubing 308 can be made of any suitable insulating material including but not limited to polyethylene, polypropylene, or epoxy resins. The TEC 300 can further include a metal sheath 304, which can further protect the interior wire 310 by providing a pressure barrier between the interior wire and a wellbore environment. The metal sheath 304 may be made of copper, aluminum, or steel alloys or of other suitable materials. Additionally, a filling material 306, such as epoxy resin, polyurethane, or silicone, can fill a void between the insulated tubing 308 and the metal sheath 304 to maintain a position of the interior wire 310 within the TEC 300.

The TEC 300 can further include a conductive encapsulation layer 302, which can be an outermost layer of the TEC 300. The conductive encapsulation layer 302 can provide vibration dampening and enable some deformation of the TEC 300. The conductive encapsulation layer 302 can be made of a polymer or other suitable materials with conductive properties. The conductive properties can be added to the polymer or may be inherent to a material of the conductive encapsulation layer 302. The conductive properties may be added to too or enhanced for the polymer or other suitable material by adding an electrically conductive particulate or an electrically conductive fiber to the polymer or other suitable material. The polymer may consist of polyethylene, polypropylene, cross-linked polyethylene, epoxy-based resins, other suitable materials, or a combination thereof. Examples of the electrically conductive fibers can include metal fibers such as steel wool, copper fiber, stainless steel fiber, aluminum fiber, carbon fiber, nickel fiber, titanium fiber, etc. Additionally, examples of the electrically conductive particulates may include metal particulates such as aluminum powder, iron powder, bronze powder, copper power, silver powder, nickel powder, etc.

In a particular example, the electrically conductive particulate or the electrically conductive fiber may be added to the polymer during an encapsulation process of the TEC 300. The encapsulation process may include mixing the electrically conductive fiber or the electrically conductive particulate with the polymer or other suitable material. Then, the mixture may be applied to a metal sheath of the TEC 204 via an extrusion process, injection molding, or another suitable technique. The mixture may then undergo a cooling and curing process through which the mixture can solidify and form a durable bond with the metal sheath.

Figure 4:
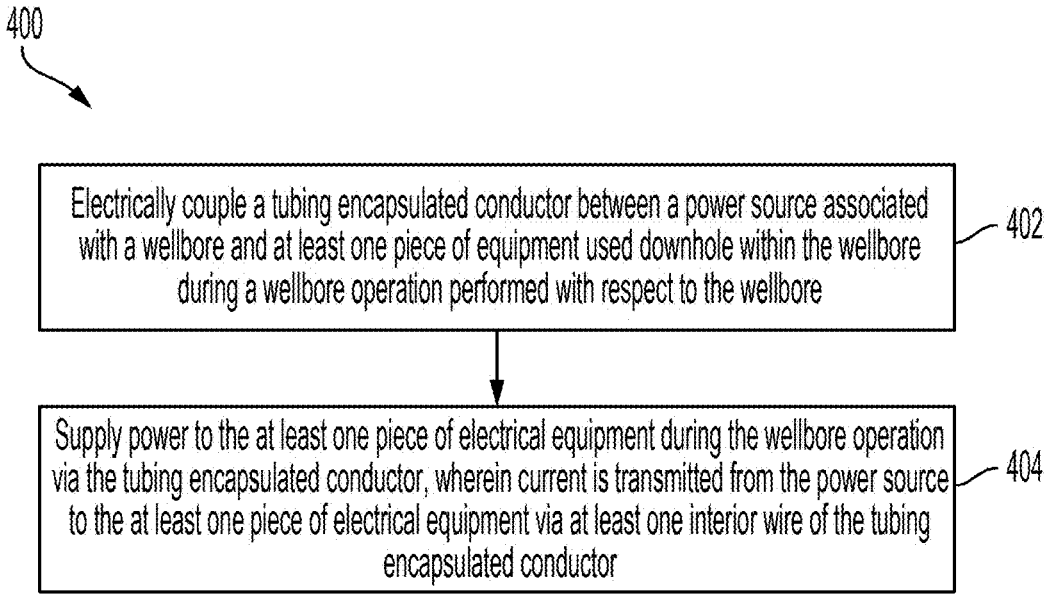
FIG. 4 is a flowchart of a process for supplying power to electrically operated equipment using a TEC with a conductive encapsulation layer according to one example of the present disclosure.

FIG. 4 is a flowchart of a process for supplying power to electrical equipment using a Tubing Encapsulated Conductor (TEC) with a conductive encapsulation layer according to one example of the present disclosure. FIG. 4 is described with reference to FIGS. 1-3.

At block 402, the process 400 involves electrically coupling a TEC 140 between a power source 104 associated with a wellbore 122 and at least one piece of electrical equipment 138 used downhole within the wellbore 122 during a wellbore operation performed with respect to the wellbore 122. The wellbore operation can be a deployment operation in which the electrical equipment 138 is being deployed into the wellbore 122. The power source 104 can be at a surface of the wellbore 122 and may include a generator, connection to an electrical grid, or another suitable power source. The electrical equipment 138 can include sensors, valves, pumps, or other suitable electrically operated downhole equipment used for wellbore operations.

At block 404, the process 400 involves supplying power to the at least one piece of electrical equipment 138 during the wellbore operation via the tubing encapsulated conductor 140. Current can be transmitted from the power source 104 to the electrical equipment 138 via at least one interior wire of the tubing encapsulated conductor 140. The current can further return to the power source 104 via a tubing, such as a production tubing string 118, positioned downhole in the wellbore.

For the current to return via the tubing, the tubing can be electrically coupled to a metal sheath of the TEC 140 via a conductive encapsulation layer of the TEC 140. For example, the TEC 140 can be in contact with the tubing at one or more locations. In some examples, the TEC 140 can be held against the tubing at the one or more locations by one or more cross coupling clamps or another suitable coupling mechanism. The current can be transmitted from the electrical equipment 138 to the metal sheath of the TEC 140. Then, at the locations where the TEC 140 is in contact with the tubing, the current can be transmitted to the tubing due to the conductivity of the conductive encapsulation layer. In this way, the tubing can act as a ground for the TEC 140 during the deployment operation.

In some aspects, systems, methods, or tubing encapsulated conductors for supplying power to downhole equipment are provided according to one or more of the following examples:

Example 1 is a system comprising: a tubing positionable downhole in a wellbore; a tubing encapsulated conductor, wherein at least a portion of the tubing encapsulated conductor is positionable downhole in the wellbore to contact the tubing at a plurality of locations along a length of the tubing, the tubing encapsulated conductor comprising: at least one interior wire positionable to transmit electricity from a power source associated with the wellbore to at least one piece of electrical equipment during a wellbore operation performed with respect to the wellbore, the at least one piece of electrical equipment positionable downhole in the wellbore; a metal sheath positionable around the at least one interior wire; and a conductive encapsulation layer positionable on an outer side of the metal sheath to facilitate a plurality of electrical couplings between the metal sheath and the tubing at the plurality of locations.

Example 2 is the system of example(s) 1, wherein the conductive encapsulation layer comprises an electrically conductive particulate, an electrically conductive fiber, or a combination thereof and a polymer, wherein the electrically conductive particulate, the electrically conductive fiber, or both are added to the polymer during an encapsulation process of the tubing encapsulated conductor.

Example 3 is the system of example(s) 1-2, wherein the tubing further comprises a plurality of cross-coupling clamps positionable at the plurality of locations, wherein each of the plurality of cross-coupling clamps electrically and mechanically couples the tubing encapsulated conductor to the tubing.

Example 4 is the system of example(s) 1-3, wherein the tubing encapsulated conductor further comprises at least one insulated tubing positionable around each of the at least one interior wire to provide electrical and mechanical protection for the at least one interior wire.

Example 5 is the system of example(s) 1-4, wherein the tubing encapsulated conductor further comprises a filling material positionable between the at least one interior wire and the metal sheath to maintain a position of the at least one interior wire within the tubing encapsulated conductor.

Example 6 is the system of example(s) 1-5, wherein the wellbore operation is a tubing deployment operation.

Example 7 is the system of example(s) 1-6, wherein the portion of the tubing encapsulated conductor positionable downhole is a first portion, and wherein a second portion of the tubing encapsulated conductor is positionable on a drum associated with the wellbore, wherein the conductive encapsulation layer is configured to facilitate a plurality of electrical couplings between a plurality of layers of the second portion of tubing encapsulated conductor.

Example 8 is a tubing encapsulated conductor comprising: at least one interior wire positionable to transmit electricity from a power source associated with a wellbore to at least one piece of electrical equipment during a wellbore operation performed with respect to the wellbore, the at least one piece of electrical equipment positionable downhole in the wellbore; a metal sheath positionable around the at least one interior wire; and a conductive encapsulation layer positionable on an outer side of the metal sheath to facilitate at least one electrical coupling between the metal sheath and a tubing at at least one location along a length of the tubing, the tubing positionable downhole in the wellbore and in contact with the conductive encapsulation layer at the at least one location.

Example 9 is the tubing encapsulated conductor of example(s) 8, wherein the conductive encapsulation layer comprises an electrically conductive particulate or an electrically conductive fiber and a polymer, wherein the electrically conductive particulate, the electrically conductive fiber, or both are added to the polymer during an encapsulation process of the tubing encapsulated conductor.

Example 10 is the tubing encapsulated conductor of example(s) 8-9, wherein the tubing further comprises at least one cross-coupling clamp positionable at the at least one location, wherein the at least one cross-coupling clamp electrically and mechanically couples the tubing encapsulated conductor to the tubing.

Example 11 is the tubing encapsulated conductor of example(s) 8-10, further comprising at least one insulated tubing positionable around each of the at least one interior wire to provide electrical and mechanical protection for the at least one interior wire.

Example 12 is the tubing encapsulated conductor of example(s) 8-11, further comprising a filling material positionable between the at least one interior wire and the metal sheath to maintain a position of the at least one interior wire within the tubing encapsulated conductor.

Example 13 is the tubing encapsulated conductor of example(s) 8-12, wherein the wellbore operation is a tubing deployment operation.

Example 14 is the tubing encapsulated conductor of example(s) 8-13, wherein a first portion of the tubing encapsulated conductor is positionable downhole in the wellbore, and wherein a second portion of the tubing encapsulated conductor is positionable on a drum associated with the wellbore, wherein the conductive encapsulation layer is configured to facilitate a plurality of electrical couplings between a plurality of layers of the second portion of tubing encapsulated conductor.

Example 15 is a method comprising: electrically coupling a tubing encapsulated conductor between a power source associated with a wellbore and at least one piece of electrical equipment used downhole within the wellbore during a wellbore operation performed with respect to the wellbore; supplying power to the at least one piece of electrical equipment during the wellbore operation via the tubing encapsulated conductor, wherein current is transmitted from the power source to the at least one piece of electrical equipment via at least one interior wire of the tubing encapsulated conductor, and wherein the current returns to the power source via a tubing positioned downhole in the wellbore, wherein the tubing is electrically coupled to a metal sheath of the tubing encapsulated conductor via a conductive encapsulation layer of the tubing encapsulated conductor.

Example 16 is the method of example(s) 15, wherein the conductive encapsulation layer comprises an electrically conductive particulate or an electrically conductive fiber and a polymer, wherein the electrically conductive particulate the electrically conductive fiber, or both are added to the polymer during an encapsulation process of the tubing encapsulated conductor.

Example 17 is the method of example(s) 15-16, wherein the tubing further comprises a plurality of cross-coupling clamps, wherein each of the plurality of cross-coupling clamps electrically and mechanically couples the tubing encapsulated conductor to the tubing.

Example 18 is the method of example(s) 15-17, wherein the tubing encapsulated conductor further comprises at least one insulated tubing positioned around each of the at least one interior wire to provide electrical and mechanical protection for the at least one interior wire.

Example 19 is the method of example(s) 15-18, wherein the tubing encapsulated conductor further comprises a filling material positioned between the at least one interior wire and the metal sheath to maintain a position of the at least one interior wire within the tubing encapsulated conductor.

Example 20 is the method of example(s) 15-19, wherein the wellbore operation is a tubing deployment operation.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing positionable downhole in a wellbore;

a tubing encapsulated conductor, wherein at least a portion of the tubing encapsulated conductor is positionable downhole in the wellbore to contact the tubing at a plurality of locations along a length of the tubing, the tubing encapsulated conductor comprising:

at least one interior wire positionable to transmit electricity from a power source associated with the wellbore to at least one piece of electrical equipment during a wellbore operation performed with respect to the wellbore, the at least one piece of electrical equipment positionable downhole in the wellbore;

a metal sheath positionable around the at least one interior wire; and a conductive encapsulation layer positionable on an outer side of the metal sheath to facilitate a plurality of electrical couplings between the metal sheath and the tubing at the plurality of locations; and wherein the tubing further comprises a plurality of cross-coupling clamps positionable at the plurality of locations, wherein each of the plurality of cross-coupling clamps electrically and mechanically couples the tubing encapsulated conductor to the tubing.

2. The system of claim 1, wherein the conductive encapsulation layer comprises an electrically conductive particulate, an electrically conductive fiber, or a combination thereof and a polymer, wherein the electrically conductive particulate, the electrically conductive fiber, or both are added to the polymer during an encapsulation process of the tubing encapsulated conductor.

3. The system of claim 1, wherein the tubing encapsulated conductor further comprises at least one insulated tubing positionable around each of the at least one interior wire to provide electrical and mechanical protection for the at least one interior wire.

4. The system of claim 1, wherein the tubing encapsulated conductor further comprises a filling material positionable between the at least one interior wire and the metal sheath to maintain a position of the at least one interior wire within the tubing encapsulated conductor.

5. The system of claim 1, wherein the wellbore operation is a tubing deployment operation.

6. The system of claim 1, wherein the portion of the tubing encapsulated conductor positionable downhole is a first portion, and wherein a second portion of the tubing encapsulated conductor is positionable on a drum associated with the wellbore, wherein the conductive encapsulation layer is configured to facilitate a plurality of electrical couplings between a plurality of layers of the second portion of tubing encapsulated conductor.

7. A tubing encapsulated conductor comprising:

at least one interior wire positionable to transmit electricity from a power source associated with a wellbore to at least one piece of electrical equipment during a wellbore operation performed with respect to the wellbore, the at least one piece of electrical equipment positionable downhole in the wellbore;

a metal sheath positionable around the at least one interior wire; and a conductive encapsulation layer positionable on an outer side of the metal sheath to facilitate at least one electrical coupling between the metal sheath and a tubing at at least one location along a length of the tubing, the tubing positionable downhole in the wellbore and in contact with the conductive encapsulation layer at the at least one location, wherein the tubing further comprises at least one cross-coupling clamp positionable at the at least one location, and wherein the at least one cross-coupling clamp electrically and mechanically couples the tubing encapsulated conductor to the tubing.

8. The tubing encapsulated conductor of claim 7, wherein the conductive encapsulation layer comprises an electrically conductive particulate or an electrically conductive fiber and a polymer, wherein the electrically conductive particulate, the electrically conductive fiber, or both are added to the polymer during an encapsulation process of the tubing encapsulated conductor.

9. The tubing encapsulated conductor of claim 7, further comprising at least one insulated tubing positionable around each of the at least one interior wire to provide electrical and mechanical protection for the at least one interior wire.

10. The tubing encapsulated conductor of claim 7, further comprising a filling material positionable between the at least one interior wire and the metal sheath to maintain a position of the at least one interior wire within the tubing encapsulated conductor.

11. The tubing encapsulated conductor of claim 7, wherein the wellbore operation is a tubing deployment operation.

12. The tubing encapsulated conductor of claim 7, wherein a first portion of the tubing encapsulated conductor is positionable downhole in the wellbore, and wherein a second portion of the tubing encapsulated conductor is positionable on a drum associated with the wellbore, wherein the conductive encapsulation layer is configured to facilitate a plurality of electrical couplings between a plurality of layers of the second portion of tubing encapsulated conductor.

13. A method comprising:

electrically coupling a tubing encapsulated conductor between a power source associated with a wellbore and at least one piece of electrical equipment used downhole within the wellbore during a wellbore operation performed with respect to the wellbore;

supplying power to the at least one piece of electrical equipment during the wellbore operation via the tubing encapsulated conductor, wherein current is transmitted from the power source to the at least one piece of electrical equipment via at least one interior wire of the tubing encapsulated conductor, and wherein the current returns to the power source via a tubing positioned downhole in the wellbore, wherein the tubing is electrically coupled to a metal sheath of the tubing encapsulated conductor via a conductive encapsulation layer of the tubing encapsulated conductor.

14. The method of claim 13, wherein the conductive encapsulation layer comprises an electrically conductive particulate or an electrically conductive fiber and a polymer, wherein the electrically conductive particulate the electrically conductive fiber, or both are added to the polymer during an encapsulation process of the tubing encapsulated conductor.

15. The method of claim 13, wherein the tubing further comprises a plurality of cross-coupling clamps, wherein each of the plurality of cross-coupling clamps electrically and mechanically couples the tubing encapsulated conductor to the tubing.

16. The method of claim 13, wherein the tubing encapsulated conductor further comprises at least one insulated tubing positioned around each of the at least one interior wire to provide electrical and mechanical protection for the at least one interior wire.

17. The method of claim 13, wherein the tubing encapsulated conductor further comprises a filling material positioned between the at least one interior wire and the metal sheath to maintain a position of the at least one interior wire within the tubing encapsulated conductor.

18. The method of claim 13, wherein the wellbore operation is a tubing deployment operation.

* * * * *